US007218205B2

(12) United States Patent
Fisler

(10) Patent No.: US 7,218,205 B2
(45) Date of Patent: May 15, 2007

(54) VARIABLE CANDELA STROBE WITH CONSTANT TRIGGER VOLTAGE

(75) Inventor: Charles F. Fisler, Sycamore, IL (US)

(73) Assignee: Honeywell International, Inc., Morristown, NJ (US)

( * ) Notice: Subject to any disclaimer, the term of this patent is extended or adjusted under 35 U.S.C. 154(b) by 211 days.

(21) Appl. No.: 11/018,304

(22) Filed: Dec. 21, 2004

(65) Prior Publication Data

US 2005/0140520 A1 Jun. 30, 2005

Related U.S. Application Data

(63) Continuation-in-part of application No. 10/429,900, filed on May 5, 2003, now Pat. No. 6,856,241.

(51) Int. Cl.
*G08B 5/00* (2006.01)

(52) U.S. Cl. ..... 340/331; 340/321; 340/815.4; 396/164; 396/206

(58) Field of Classification Search ..... 340/331, 340/321, 512, 509, 293, 815.4; 315/241 P, 315/241 R, 241 S; 396/205, 164, 206
See application file for complete search history.

(56) References Cited

U.S. PATENT DOCUMENTS

| | | | | |
|---|---|---|---|---|
| 4,618,803 | A | 10/1986 | Hardy | 315/241 |
| 4,668,935 | A | 5/1987 | McDermott | 340/332 |
| 4,684,852 | A | 8/1987 | Balogh | 315/241 |
| 4,839,686 | A | 6/1989 | Hosomizu et al. | 354/416 |
| 4,951,081 | A | 8/1990 | Hosomizu et al. | 354/415 |
| 5,249,007 | A | 9/1993 | Tanaka | 354/145 |
| 5,313,247 | A | 5/1994 | Hosomizu et al. | 354/415 |
| 5,341,069 | A * | 8/1994 | Kosich et al. | 315/241 S |
| 5,523,654 | A | 6/1996 | Sikora et al. | 315/241 |
| 5,570,077 | A * | 10/1996 | Swieboda | 340/331 |
| 6,031,340 | A * | 2/2000 | Brosius | 315/227 R |
| 6,243,001 | B1 | 6/2001 | Kodaka | 340/326 |
| 6,278,382 | B1 | 8/2001 | DeMarco et al. | 340/981 |
| 6,311,021 | B1 | 10/2001 | Kosich | 396/164 |
| 6,411,201 | B1 | 6/2002 | Hur et al. | 340/332 |
| 6,522,261 | B2 | 2/2003 | Scheffler et al. | 340/815.73 |
| 6,661,337 | B2 * | 12/2003 | Ha et al. | 340/293 |
| 6,856,241 | B1 * | 2/2005 | Tice et al. | 340/331 |

OTHER PUBLICATIONS

Advertisement—Amseco—"Take a Closer Look at our Select-A-Strobe™ Family of Products", appearing in Security Dealer, May 2000, p. 74.

Data Sheet—Amseco Select-A-Horn/Strobe™ Combination—SHW24-153075, 4 pgs., May 1999.

(Continued)

*Primary Examiner*—Anh V. La
(74) *Attorney, Agent, or Firm*—Welsh & Katz, Ltd.

(57) ABSTRACT

A variable candela strobe unit couples a substantially constant trigger voltage to a trigger electrode of a gas discharge tube irrespective of the voltage provided across the tube which is specified by a selected candela output value. The trigger voltage is great enough at low candela output settings to provide reliable triggering. It is not high enough even at the highest output settings to cause arcing of the associated step-up transformer.

30 Claims, 2 Drawing Sheets

OTHER PUBLICATIONS

Edwards Systems Technology—EST Literature Sheet #85001-0549, 4 pgs. 2002.

EG&G Heimann Optoelectronics Flashtubes—Catalog—4 pgs., published more than a year prior to the filing date of the present application.

Wheelock Inc.—Series E Single & Multi-Candela Speakers & Speaker Strobes, 2002, 4 pgs.

* cited by examiner

VARIABLE CANDELA STROBE WITH CONSTANT TRIGGER VOLTAGE

CROSS REFERENCE TO RELATED APPLICATION

This is a continuation-in-part application of U.S. patent application Ser. No. 10/429,900 filed May 5, 2003 now U.S. Pat. No. 6,856,241, entitled "Variable Candela Strobe".

FIELD OF THE INVENTION

The invention pertains to strobe devices of a type used in alarm systems. More particularly, the invention pertains to strobe devices with selectable candela outputs.

BACKGROUND OF THE INVENTION

Strobe devices require the application of a relatively high voltage across a flash tube in order to produce a gaseous discharge in the tube. In known devices, this high voltage is achieved by using a charge pump to transfer energy to an internal capacitor from an external energy source. The external source typically can be nominally 12 volts or 24 volts.

The capacitor is coupled in parallel with the flash tube and provides the energy for the flash. The amount of light from the flash tube is directly proportional to the energy stored in the capacitor that is discharged into the flash tube.

A single capacitor can be charged to various voltages in order to provide a multi-candela (multi-intensity) unit. However, there are limitations on the range of candela (intensity) that can be reliably achieved. One problem is that to flash the tube requires that the voltage across it be greater than a predetermined threshold amount (e.g. 180 volts) for reliable operation.

Present designs for multi-candela strobes include a range of 15 candela to 100 candela. To achieve such outputs, the capacitor needs to be charged to 240 volts for the 100 candela, but will only need to be charged to 120 volts for the 15 candela output. The 120 volts is, however, below the exemplary 180 volts needed for reliable operation.

In order to overcome this low voltage problem, known designs incorporate a voltage booster circuit to increase the voltage across the flash tube. One type of a voltage booster circuit is a voltage doubler circuit. One known voltage doubler design is disclosed in a "flashtubes" EG&G Heimann Optoelectronics Catalog, pg. 7, 1991. This document discloses a voltage doubler circuit to be used with a flash tube.

A prior art strobe unit with a known doubler is illustrated in FIG. 1. A capacitor C3 stores the energy that is going to determine the candela of the flash. It is coupled across a series combination of a flash tube LP1 and a diode D13.

Capacitor C13 is the doubler capacitor. It is charged through resistor R15 to the same voltage Vc as capacitor C3 is charged. The polarities of the voltages on the capacitors C3 and C13 are the same. Capacitor C4 is used for the trigger function and is charged to the same voltage and polarity as is capacitor C13. Hence, the trigger voltage, across capacitor C4 tracks the value of Vc. As Vc varies, based on desired candela output, so does the trigger voltage. Thus, the trigger voltage may be excessive at high candela outputs. Additionally, at low candela settings, the trigger voltage may not be high enough to produce reliable ignition of the flash tube LP1.

When the unit is triggered, by a signal from the trigger circuit, SCR Q8 will conduct and pull node A low. This causes C4 to discharge through Q8 and the primary winding of TR2, the trigger transformer.

Until the flash tube is triggered by the voltage out of the secondary winding of TR2, C13 and C3 cannot discharge. However, the voltage across the flash tube at this time is double the voltage VC of C3 (far exceeding the minimum required voltage). In FIG. 1, the voltage across capacitor C4 is the same as the voltage stored in the capacitor C3. The turns ratio of transformer TR2 is designed to provide 6 KV output when the capacitor C3 has been charged up to about 220 volts. As noted above, at low candela settings, the trigger voltage may be too low to be sure that the tube will be triggered. At high candela settings, the voltage can become so high that the transformer may start to arc and to fail.

When the tube flashes, it first discharges capacitor C13, then capacitor C3. The energy stored in capacitor C3 provides the preselected candela output from tube LP1.

While known devices provide a selectable candela output, the use of a voltage doubler does have some disadvantages. At high output intensities, the voltage across the tube LP1 is substantially equal to 2 VC which can be quite high. This high voltage requires the use of components rated therefore. In addition, in compact units with the circuitry implemented on a printed circuit board, arcing is a potential problem. Further, it would be preferable if the trigger voltage was not dependent on candela setting since the voltage Vc can vary widely as a function thereof.

There thus continues to be a need for multi-candela strobe units which provide reliable, triggerable light of a selected intensity. Preferably such reliability could be achieved in compact, high density packaging, without the necessity of high voltage components. It would also be preferable if operational reliability could be achieved while simultaneously eliminating arcing during normal operation.

DETAILED DESCRIPTION OF THE EMBODIMENTS

Figure 1:
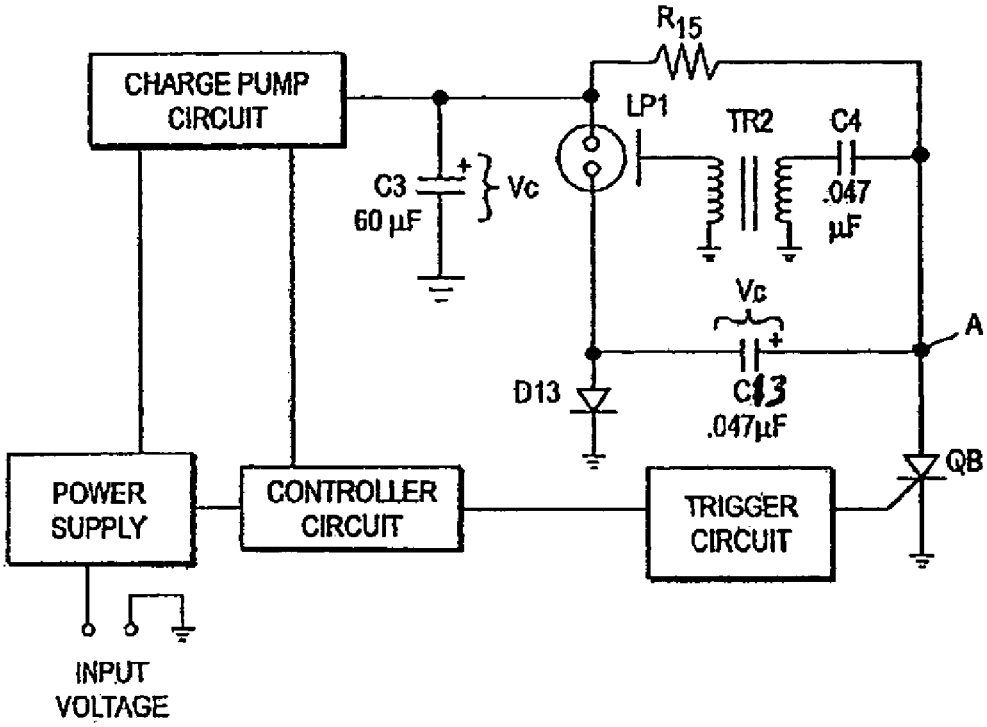
FIG. 1 PRIOR ART
FIG. 1 is a schematic diagram of a prior art strobe alarm.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

The disadvantages of the prior art above can be overcome with a power supply in accordance with the invention. A more controlled voltage is achieved across the flash tube using a voltage booster circuit that is not a "doubler" but rather an "adder" type circuit. The present circuit operates significantly differently than the prior art circuits. The parent application hereto Ser. No. 10/429,900 filed May 5, 2003 and assigned to the assignee hereof is hereby incorporated by reference.

It would be advantageous to achieve a broad candela range, for example 15–185 candela, by adjusting the charge pump rate and controller circuit thresholds, and without physically changing component values in the circuit. This means that the voltage across the main energy storage capacitor, C3 must vary across a wide range. This present problem is solved by the present invention, by making sure that the gas discharge tube is driven within its specified limits even near the ends of the candela output range.

Figure 2A:
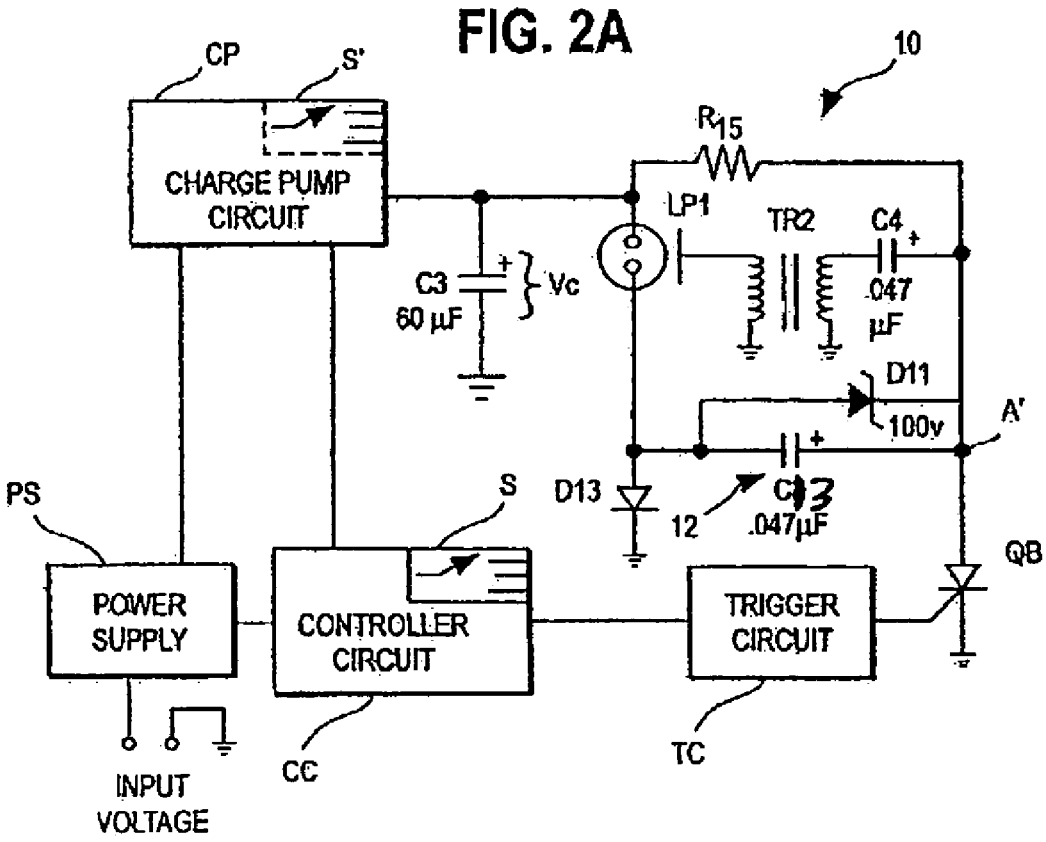
FIG. 2A is a schematic diagram of a first embodiment of the invention.
Figure 2B:
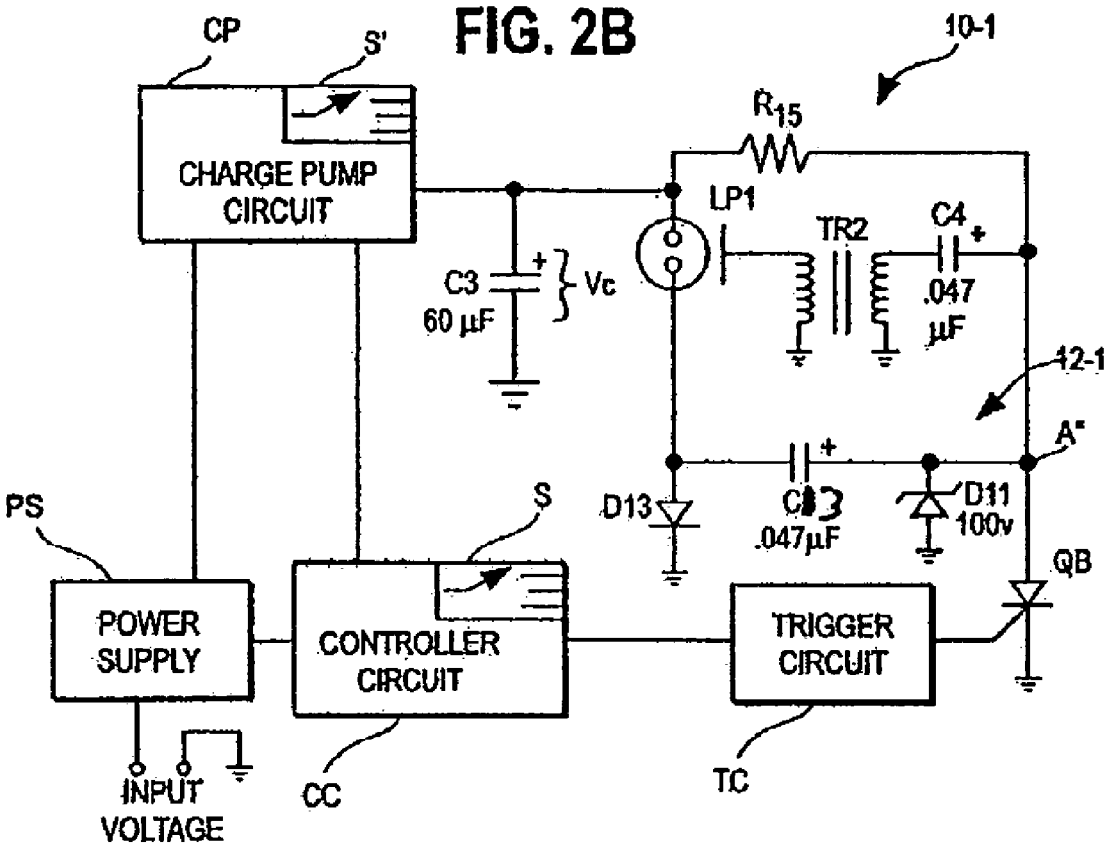
FIG. 2B is a schematic diagram of a second embodiment of the invention.

FIGS. 2A, 2B illustrate two different embodiments 10, 10-1 of strobe alarms in accordance with the invention. In both FIGS. 2A, 2B the maximum voltage capable of being applied across tube LP1 is the sum of Vc, the voltage across capacitor C3 plus the voltage across an off-set circuit 12, FIG. 2A or 12-1, FIG. 2B. This total voltage, as discussed below, will be substantially less than 2 Vc but great enough to produce reliable, repeatable flashing of tube LP1.

In FIG. 2A, a power supply PS provides energy for circuit 10, from a remote source. Supply PS is coupled to controller CC, and charge pump circuit CP as well as other circuitry as would be known to those of skill in the art. The output of charge pump CP couples energy to capacitor C3 and other components of circuit 10 as discussed subsequently. Trigger circuit TC provides trigger gate signals to SCR Q8.

Candela selecting switches S or S' can be coupled to either controller CC or charge pump CP without limitation. Switch settings can be established manually, electronically or both without limitation.

In FIG. 2A, an off-set circuit 12 includes a Zener diode D11 which is coupled, in parallel, with the capacitor C13. Diode D11 causes the voltage of node A', Q8, C4', and C13' to be clamped to a known, predetermined voltage (e.g. 100 volts). This voltage is limited by the off-set circuit 12, for example by the voltage across D11. It will not vary with the different charging voltages of C3 used to obtain the different candela rating. Alternate sources, such as a power supply could be used instead of capacitor C13 without limitation.

When the capacitors have been charged, the voltage across the flash tube is VFT=Vc+VD11 at the time that the tube LP1 is flashed. The addition of the diode D11 limits the voltage variations across tube LP1. It is possible to control the total voltage across the flash tube LP1 to tighter limits than is achieved by a prior art voltage doubler. The tighter voltage range is demonstrated in Table 1 which compares a voltage limiter as in FIG. 2A to a doubler, as in FIG. 1.

In the embodiment of FIG. 2A, the flash tube LP1 requires 180 volts minimum to flash reliably. Table 1 illustrates that both the circuits of FIG. 1 and FIG. 2A create voltages greater than 180 volts to satisfy this requirement. However, at the highest candela rating, the circuit of FIG. 2A applies 140 volts less to tube LP1 than does the circuit of FIG. 1. This is a significant difference.

The limiter circuit 12 couples a smaller range of voltages across the flash tube LP1 while operating from 15 candela to 100 candela than do the prior art doubler-circuits. The lower over-all voltage translates to reduced breakdown voltage specifications for the various components (less expensive) and possibly to a more compact spacing, higher density of circuit board points, without arcing, than is the case with the voltage doubler configuration of FIG. 1.

TABLE 1

| Candela Rating | Voltage With Limiter 12 | Voltage With Doubler |
|---|---|---|
| 15 | 220 | 240 |
| 30 | 240 | 280 |
| 110 | 340 | 480 |

It will be understood that the specific minimum threshold voltage to flash the tube LP1 reliably may vary as a result of tube geometry, gas and the like without limitation. Such variations come within the spirit and scope of the invention. As discussed below, for a given tube and geometry, it is preferable to provide a constant trigger voltage irrespective of candela setting. Both circuits 10, 10-1 produce a stable trigger voltage. Table 1 makes it clear that the voltage across the flash tube varies less across a range of different candela outputs with the limiter circuit 12 than in the prior art. Both capacitor values and the value of the constant voltage used in the limiter circuit of FIG. 2A can be changed to different values without departing from the scope of this invention. Even with such variations in circuit components, a constant trigger voltage will still be applied to tube LP1.

FIG. 2B illustrates an alternate embodiment 10-1. Components common to those in FIG. 2A have been designated with the same identification numerals. In FIG. 2B, a limiting circuit 12-1 includes capacitor C13 and Zener diode D11, between node A" and ground. Circuit 12-1 limits the total voltage across LP1 prior to a trigger event. In circuit 12-1, current through Zener D11 does not flow through diode D13.

As illustrated in FIG. 2B, Zener diode D11 sets the trigger voltage across capacitor C4 to about 100 volts. This voltage is independent of candela setting. This provides a stable trigger circuit input voltage.

The trigger voltage is generated by step-up transformer TR2. The output of transformer TR2 is intended to provide about 6 KV at the outside surface of the tube, or bulb LP1. Based on a 100 volt input, the 6 KV output initiates a flash sequence. This corresponds to a turns ratio on the order of 60:1. Other turns ratios come within the spirit and scope of the invention. This high voltage is produced when the switching action of the circuit causes the voltage across capacitor C4 to be coupled to the primary side of transformer TR2.

The voltage across the flash tube LP1 can also be established by the use of a non-booster type circuit design. In this embodiment, two capacitors are still used. They are coupled in parallel, not in series with the flash tube as in the prior art.

In summary, the embodiments 10, and 10-1 illustrate driving circuits which provide alternates to voltage doubler circuitry for purposes of generating selectable candela output levels in a strobe alarm. In all instances, a voltage substantially less than twice the voltage on the major illumination providing storage element is added to that voltage to initiate ignition of an ionization gas discharge tube. Subsequently, the energy stored in the primary storage capacitor is used to provide the selected candela output level for the circuit. A constant trigger voltage is provided to drive the trigger electrode of the discharge tube via the step-up transformer.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An alarm strobe comprising:

a housing:

a device to select an output light level, the device is carried by the housing;

a gas filled output element carried by the housing;

a power supply, coupled to the device and the output element, the supply provides sufficient energy, in response to a triggering event, to initiate a discharge of the output element and produce the selected output light level, the supply has a capacitor and a voltage limiting circuit, the capacitor and circuit are coupled in series with the output element in response to the triggering event and, including circuitry to couple a constant trigger voltage to the output element irrespective of the selected output light level.

2. A strobe as in claim 1 where the circuit includes an energy storage element configured to exhibit a voltage which is a fraction of a voltage across the capacitor prior to the triggering event.

3. A strobe as in claim 1 where the circuit includes a second capacitor configured to exhibit a voltage which is a fraction of a voltage across the capacitor prior to the triggering event.

4. A strobe as in claim 3 where the circuit includes at least one diode.

5. A strobe as in claim 4 where the second capacitor and the diode have a common node.

6. A strobe as in claim 5 where the second capacitor and the diode are coupled in parallel at least for a time interval subsequent to the triggering event.

7. A strobe as in claim 6 where the second capacitor and the diode establish a limiting voltage which during at least part of the time interval has a polarity which is additive to the voltage across the capacitor.

8. A strobe as in claim 6 where the diode comprises a Zener diode.

9. A strobe as in claim 1 where the voltage limiting circuit limits total voltage across the output element to be less than 1.9 times the voltage across the capacitor prior to a triggering event.

10. A method of generating a variable intensity visible alarm indicating output comprising:

establishing a selection indicium indicative of a selected output intensity;

establishing first and second energy sources where one source exhibits a voltage which is a fraction of a second voltage exhibited by the other source;

providing a substantially constant voltage triggering indicium;

using both sources with the voltages in one of series or parallel to produce an initial discharge and then subsequent illumination in accordance with the selection indicium.

11. A method as in claim 10 which includes beginning to discharge one of the energy sources before the other.

12. A method as in claim 10 which includes limiting the voltage of the sources so as to substantially eliminate high voltage arcing.

13. A method as in claim 10 which includes providing first and second capacitors in the respective energy sources to store respective amounts of energy.

14. A method as in claim 13 which includes configuring the capacitors in parallel for at least a selected time interval during the discharge.

15. A method as in claim 13 which includes configuring the capacitors in series for at least a selected time interval during the discharge.

16. A method as in claim 10 where the selection indicium is manually settable.

17. A strobe comprising:

an optical output device;

a selector element for selection of an optical output;

a control circuit which includes charging circuitry, the control circuit is coupled to the selector element and the output device;

first and second energy storage circuits, coupled to the control circuit, with one storage circuit exhibiting additional energy at a voltage not present at the other storage circuit, the control circuit coupling the energy storage circuits in one of a parallel and a series configuration to the optical output device to product the selected optical output; and a circuit to couple a substantially constant trigger voltage to the output device.

18. A strobe as in claim 17 which includes in one storage circuit a capacitor having a value more than one hundred times greater than a capacitor in the other storage circuit.

19. A strobe as in claim 17 where a maximum voltage present across any pair of component leads is less than twice a maximum capacitor charging voltage and is inadequate to produce arcing for a selected component density.

20. A strobe alarm unit comprising:

a housing;

a gas filled output member carried by the housing;

an output selector carried on the housing;

first and second energy storage elements coupled at least during selected time intervals to the output member and an isolating element coupled between the elements with one element facilitating a discharge in the member, in response to a substantially constant energy trigger event with the other element initially isolated therefrom and with the other element subsequently coupled thereto to facilitate a discharge in the member in accordance with the output selector.

21. A strobe alarm unit as in claim 20 where the isolating element comprises a semiconductor switch.

22. A strobe alarm unit as in claim 21 where the switch has one of two terminals or three terminals.

23. A strobe alarm unit as in claim 20 with one capacitor charged to a voltage which is a fraction of a voltage to which the other capacitor is charged.

24. A strobe alarm unit as in claim 20 with one capacitor charged to a voltage that exceeds a voltage to which the other capacitor is charged by a fraction.

25. A strobe comprising:

first circuitry for establishing a charging voltage to be applied to an energy storage element, the circuitry establishes the voltage in accordance with a pre-specified light output parameter;

second circuitry for establishing a constant trigger voltage having a value independent of the light output parameter.

26. A strobe as in claim 25 where the second circuitry comprises a step-up transformer, the transformer having a substantially constant voltage coupled thereto.

27. A strobe as in claim 26 where the first circuitry includes a voltage booster circuit.

28. A strobe as in claim 26 where the pre-specified light output parameter can be varied over a predetermined range.

29. A strobe as in claim 28 where the range includes ten to two hundred candela.

30. A strobe as in claim 29 where the transformer has a turns ratio on the order of sixty to one.

* * * * *